US006732833B2

(12) United States Patent
Rogelja

(10) Patent No.: US 6,732,833 B2
(45) Date of Patent: May 11, 2004

(54) DESCENDER WITH TWO-WAY LOCKING LEVER

(76) Inventor: Boris Rogelja, 9 Nelson Avenue Padstow, New South Wales (AU), 2211

( * ) Notice: Subject to any disclaimer, the term of this patent is extended or adjusted under 35 U.S.C. 154(b) by 0 days.

(21) Appl. No.: 10/148,908

(22) PCT Filed: Dec. 14, 2000

(86) PCT No.: PCT/AU00/01535

§ 371 (c)(1),
(2), (4) Date: Aug. 16, 2002

(87) PCT Pub. No.: WO01/43830

PCT Pub. Date: Jun. 21, 2001

(65) Prior Publication Data

US 2003/0075392 A1 Apr. 24, 2003

(30) Foreign Application Priority Data

Dec. 15, 1999 (AU) ..... PQ4672

(51) Int. Cl.[7] ..... A47L 3/04; A62B 1/20; B65H 59/14

(52) U.S. Cl. ..... 182/5; 182/193; 188/65.5

(58) Field of Search ..... 182/5, 3, 192, 182/193, 191, 6, 7; 188/65.5, 65.2, 65.3, 65.4

(56) References Cited

U.S. PATENT DOCUMENTS 5,054,577 A * 10/1991 Petzl et al. ..... 182/5
5,076,400 A 12/1991 Petzl et al.
5,597,052 A 1/1997 Rogleja
5,954,153 A * 9/1999 Rogelja ..... 182/5
5,975,243 A 11/1999 Lorbek
6,029,777 A * 2/2000 Rogelja ..... 182/193

FOREIGN PATENT DOCUMENTS

DE 19520860 6/1995
EP 398-819 A 5/1989

* cited by examiner

*Primary Examiner*—Hugh B. Thompson, II
(74) *Attorney, Agent, or Firm*—Carol M. LaSalle; Bozicevic, Field & Francis LLP

(57) ABSTRACT

A descender (10) comprising a base (11) having a connection means (26), a pivotal member (12) pivotally mounted on the base (11) about a pivot axis (1), the pivotal member (12) defining first and second spaced projections (14, 15) for engaging a rope (5), the base (11) defining a stop member (18) and a lever (23) pivotable between first and second end positions, the lever (23) and the pivotal member (12) defining complementary cam surfaces (24) to regulate the distance between the stop member (18) and the second projection (15), a resistance force applied to the rope (5) being at a minimum when the second projection (15) is moved away from the stop member (18) and the lever (23) is located in a mid-position, and is at a maximum when the lever (23) moves towards either end position wherein the rope (5) is pressed between the second projection (15) and a braking surface (22).

13 Claims, 9 Drawing Sheets

DESCENDER WITH TWO-WAY LOCKING LEVER

This application is a continuation of PCT/AU00/01535, filed Dec. 14, 2000.

FIELD OF THE INVENTION

The present invention relates to "descenders" for use in abseiling.

BACKGROUND OF THE INVENTION

Abseiling is a technique used to descend steep surfaces such as cliff faces and is often used by persons involved in activities such as mountain climbing, canyoning and caving. In order to abseil down a cliff face, one end of a rope is made fast at the top of the cliff and the person making the descent then slides down the rope. The rope is passed either around the body of the person or more usually through a descender attached to a harness worn by the person such that the passage of the rope around the body or through the descender provides sufficient friction to slow the rate of descent to a safe speed.

A descender comprises rope engaging surfaces around and between which the rope travels, along a tortuous path, to provide frictional engagement between the rope and the descender. The rate of descent is normally controlled by holding the free or tail end of the rope to control the tension on the rope where it emerges from the descender and thereby to control the degree of frictional engagement between the rope and the descender which in turn controls the rate of descent.

Descenders used in abseiling vary greatly in performance and complexity, there being a variety of relatively simple devices which rely on frictional engagement between the rope and metal rings or racks about which the rope is wrapped, and a number of more complex descenders which incorporate a braking mechanism which allows the friction between the rope and the descender to be varied other than by simply controlling the free or tail end of the rope. The earliest of these more complex devices had a handle or lever which when operated tended to increase the friction between the descender and the rope. This type of descender was not a great improvement over the more simple devices as the brake was not self-engaging and therefore, if the user was knocked unconscious, he would fall in the same way as the user of the earlier devices.

An improved type of descender was disclosed in U.S. Pat. No. 4,596,314 to the present applicant which provides a descender having a simplicity of construction and operation which was not achieved by earlier prior art descenders. The descender disclosed in that application provided a variable braking action which increased when a handle was released. Therefore if the user was knocked unconscious and released the handle, the user's fall would be braked.

A disadvantage of the descender disclosed in U.S. Pat. No. 4,596,314 is that the actuation and release of the self-engaging brake can in some situations be rather abrupt or jerky. For example, it can be difficult for to inexperienced users to smoothly control the braking action.

U.S. Pat. No. 5,597,052 (also to the present applicant) provided a modification to the descender shown in U.S. Pat. No. 4,596,314 comprising a variable braking mechanism operated by a lever which allows the user to smoothly control the braking action and thereby avoid or minimise the jerkiness which can be experienced with the use of this known type of descender.

The present invention provides further safety improvements in descenders, in particular, but not exclusively, to the descender of the type described in U.S. Pat. No. 5,597,052.

SUMMARY OF THE INVENTION

The present invention provides a descender for use in abseiling comprising:

a base having a connection means for connection to a harness or the like:

a pivotal member pivotally mounted on the base about a pivot axis extending generally normal thereto, the pivot axis being spaced from the connection means;

the pivotal member having first and second spaced projections for engaging a rope, the projections both extending generally parallel to the pivot axis with the first projection being disposed generally about the pivot axis and the second projection being located substantially on the opposite side of the pivot axis with respect to the connection means;

the base further having a stop means located adjacent the second projection and a lever pivotal about a pivot extending through or located adjacent to the stop means, one end of the lever defining a handle pivotable in an arcuate path between first and second end positions; and wherein the pivotal member and the other end of the lever define complementary displacing formations the formations being shaped and configured such that as the lever travels in its arcuate path about the pivot, they regulate the distance between the stop means and the second projection whereby, in use, a rope passing around and between the first and second projections and between the second projection and the braking surface will have a resistance force applied to it which is a minimum when the second projection is moved away from the stop means by actuating the lever to cause the complementary displacing formations to contact one another and thus decrease the braking and friction forces on the rope as it passes between the second projection and the stop means and is at a maximum when the lever moves to either end position of its arcuate path wherein the rope is pressed between the second projection and the braking surface.

A first important advantage of the invention is that the lever is inherently safe as braking is at a maximum if the lever is moved to either extreme end position. Any one panicking would tend to force the lever to one side which would result in maximum braking.

A second advantage is that in manipulating the handle of U.S. Pat. No. 4,596,314 and U.S. Pat. No. 5,597,052, can be difficult when the descender is used to lower heavy loads, particularly loads approaching 500 kg or more. The handle has a short arc of travel and this does not allow continuous control but rather provides somewhat jerky movement of the load. In contrast the lever of the present invention has a greater arc of movement and provides better control adjustments when lowering heavy loads and can be used to control heavier loads of 200 kg or more with relative ease.

In one embodiment the complementary displacing formations comprise a cam surface defined on the other end of the lever and the pivotal member defines a cam follower surface.

The cam surface is typically a relatively thin plate which allows the rope to pass over it. The stop member is preferably co-axial with the pivot and may typically be generally cylindrical. This structure has cost advantages over the forged cam of U.S. Pat. No. 5,597,052. Further it can adjust the distance between the stop member and the second projection effectively reducing the drag/friction on the rope when the lever is in a mid-position.

In an alternative embodiment the cam surface is defined on the pivotal member and the cam follower is locate on the other end of the lever. The cam follower may be an annular ring which is free to rotate about its central axis.

In one embodiment, the pivotal member also has a handle means to selectively pivot the pivotal member relative to the base. In this embodiment in use, a rope passing around and between the first and second projections and between the second projection and the braking surface will have a resistance force applied thereto which is at a minimum when the second projection is selectively moved away from the stop by actuating the handle means, and is at a maximum when the handle means is released and the tension of the rope causes the second projection to bear against the stop and press the rope between the braking surface and the second projection and thereby create an additional braking force.

Preferably, the lever has a retention means at a position spaced from the cam and through which, in use, a tail of the rope passes after emerging from between the second projection and the braking surface so that the lever will move with the tail of the rope and may be actuated by changing the position of the tail of the rope relative to the descender. Preferably, the retention means is in form of a pair of recesses in the lever through which, in use, the tail of the rope is threaded.

Preferably, the first and second projections define sheaves which are fixed relative to the pivotal member.

BRIEF DESCRIPTION OF THE DRAWINGS

Preferred forms of the present invention will now be described by way of example with reference to the accompanying drawings, wherein.

BRIEF DESCRIPTION OF A PREFERRED EMBODIMENT

Figure 1:
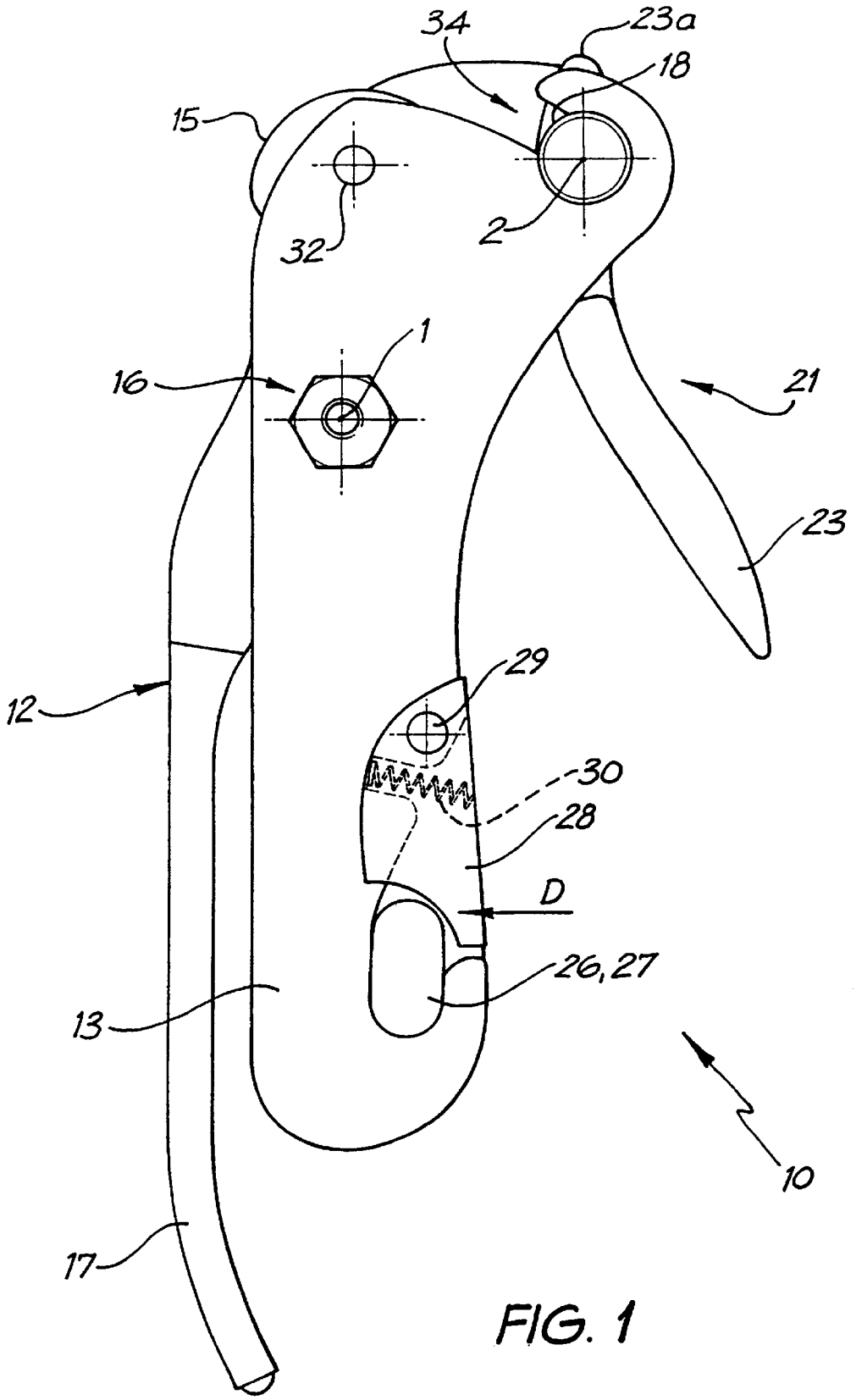
FIG. 1 is a top plan view of a first embodiment of the descender with the retention plate in its closed position.

Referring to FIGS. 1–4, there is shown a descender having a base plate 11, a pivotal member 12, and a retention plate 13.

The pivotal member 12 includes two spaced, sheaves 14 and 15 and is pivotally mounted to the base plate 11 by a pivot arrangement 16 about a pivot axis 1. The effective centre of the first sheave 14 is either co-axial with, or slightly offset from, the pivot axis 1.

The pivotal member 12 extends away from the first sheave 14 in a generally opposite direction to the second sheave 15 to provide a lever handle 17 which, when moved in the direction C (refer to FIG. 2) with respect to the baseplate 11, moves the second sheave 15 to a position remote from a stop member 18 of the baseplate 11.

The baseplate 11 has a bolt 19 spaced from the pivot axis 1 and generally adjacent the second sheave 15.

The stop member 18 is mounted on the bolt 19 and is 18 cylindrical and co-axial with axle 2 defined by the bolt 19. The surface of the stop member 18 defines a braking surface 22 against which the second sheave bears (or at least a rope located between the second sheave and the stop surface) when, in use, (refer to FIG. 2), it is urged in the direction A. The stop member 18 is integral with a lever 23 by which means the stop member 18 is pivoted about the axle 2. However, because the stop member 18 is co-axial with the axle 2, pivoting of the lever does not move the braking surface 22 relative to the second sheave 15. FIG. 2*a* is a side view of the stop member 18 and the pivoted end of the lever 23. Towards the top of the cylinder there is a cut out portion 19 extending around the circumference of the cylinder which receives the retention plate 13 when the descender is closed. The lever 23 extends beyond the axle 2 and defines a tip 23*a* forming a planar cam surface 24 shaped like a rounded arrow head. The outer surface of second sheave 15 which faces the cam surface 24 defines a cam follower surface 15*a* (see FIG. 3), The cam surface interacts with the sheave 15 in the following manner. When the second sheave moves in direction A towards the stop member 18, the cam follower surface 15*a* of the second sheave contacts the planar cam surface 24 and is prevented from moving further thereby defining a gap G between the braking surface of the stop member and the sheave 15. The gap G can be varied by pivoting the lever 23 about axle 2. The gap is greatest when the tip of the lever points towards the sheave, see FIG. 3 where the lever is shown in phantom and least when the lever points downwards (FIG. 2) or upwards, where the cam surface 24 will not, in particular, contact the sheave 15 but will be separated therefrom by the rope 5. In the interim position shown in dashed lines in FIG. 3, small changes in the angle of the lever will vary the gap slightly.

The lever 23 has a rope retention arrangement 25 at a position spaced from the stop member 18. The retention arrangement 25 is in the form of a pair of recesses 35, 36. The first recess 35 is adjacent the stop member 18 and faces away from the base plate 11. The second recess 36 is spaced from the first recess 35 away from the cylinder 18 and faces in an opposite direction to that of the first recess 35. The recesses 35, 36 are formed so that the rope can pass from between the stop member 18 and the second sheave 15 to one side of lever 23, through the first recess 35 to time other side of the lever 23, and through the second recess 36 back to the one side of the lever 23. Further, the recesses 35, 36 are formed so as to have overhanging positions 37 which, in use, serve to retain the rope in the recesses 35, 36 whilst allowing for the rope to be selectively disconnected from the lever 23. In this way, when the tail of the rope is received in the retention ion arrangement 25 and is moved relative to the base plate 11 of the descender 10, the lever 23 will move therewith so that the additional braking force can be easily controlled.

In an alternative embodiment (not shown) the retention arrangement 25 can be in the form of a clip or ring mounted to the lever 23 at a position spaced from the cam surface 24 and through which the tail of the rope can pass.

The retention plate 13 is pivotable about the same pivot axis 1 as the pivotal member 12 and allows the rope to be inserted into and removed from the descender 10 when in the open position (not shown). When the retention plate 13 is pivoted to a closed position (refer to FIG. 1) it covers the gap between the two sheaves 14 and 15 and the gap between the second sheave 15 and the stop member 18 to prevent the rope from accidentally jumping out of the descender during a descent. When in the closed position, a slot 34 the retention plate 13 engages the bolt 19 in a groove formed between the stop member 18 and a nut threadably engaged on the end of the bolt 19. In this way, the retention plate 13 is securely supported and reduces the tendency for the plate 13 to twist due to side loading of the descender by the rope.

The pivotal member 12 is pivotally connected between the baseplate 11 and the retention plate 13 in a similar way to that described in U.S. Pat. No. 4,596,314 at column 4, lines 25–64. In this way, the effective centre of the first sheave 14 can be moved relative to the cylinder 18 so that the descender 10 can be adjusted to suit different diameter ropes.

The baseplate 11 is provided with an elongated hole 26 by which the descender 10 can be permanently connected to a harness during use, the connection being generally by way of a karabiner. The retention plate 13 is provided with a slot 27 which opens through one side of the plate 13, the slot 27 being closed off by a closure member 28 pivotally connected to the plate 13 by a rivet 29 and which is biased into the closed position by a spring 30. To move the retention plate 13 to the closed position, the closure member 28 is pivoted in direction D and the karabiner which is already connected in the hole 26 of the baseplate 11 is passed through the opening in the slot 27. The closure member 28 is then released to retain the karabiner in the slot 27. To reopen the descender, the closure member is again depressed in the direction D and the karabiner removed from the slot 27 as the retention plate 13 is pivoted to the open position.

The baseplate 11 and retention plate 13 are also provided with holes 31,32 such that the braking action of the descender 10 may be inhibited by passing a karabiner or other suitable device through the hole 31 in the baseplate, the opening 33 in the centre of the second sheave 15 and the hole 32 in the retention plate 13 so as to hold the pivotal member 12 relative to the baseplate 11, and maintain the second sheave 15 away from the stop member 20 of the baseplate 11.

During use of the descender 10, a rope 5 is passed the first sheave 14 between the first and second sheaves 14, 15, around the second sheave 15, between the second sheave 15 and the braking surface 22 of the cylinder, and through the retention arrangement 25.

A minimum braking force is obtained when the handle is pulled in the direction C towards the base and retention plates 11, 13 so as to move the second sheave 15 into a position remote from the stop member 18, and wherein the rope 5 will not contact the braking surface 22 of the stop member 18. It will be recognised, however, that even under the minimum braking situation described, the speed of travel of the rope through the descender 10 can be controlled by varying the tension on the tail of the rope 5.

When the handle 17 is released, the tension on the rope 5 and the above described tortuous path of the rope 5 through the descender 10 causes the pivotal member 12 to pivot so that the second sheave 15 is urged into contact with the cam surface 24 or the rope 5 depending on the orientation of the lever 23.

Figure 2:
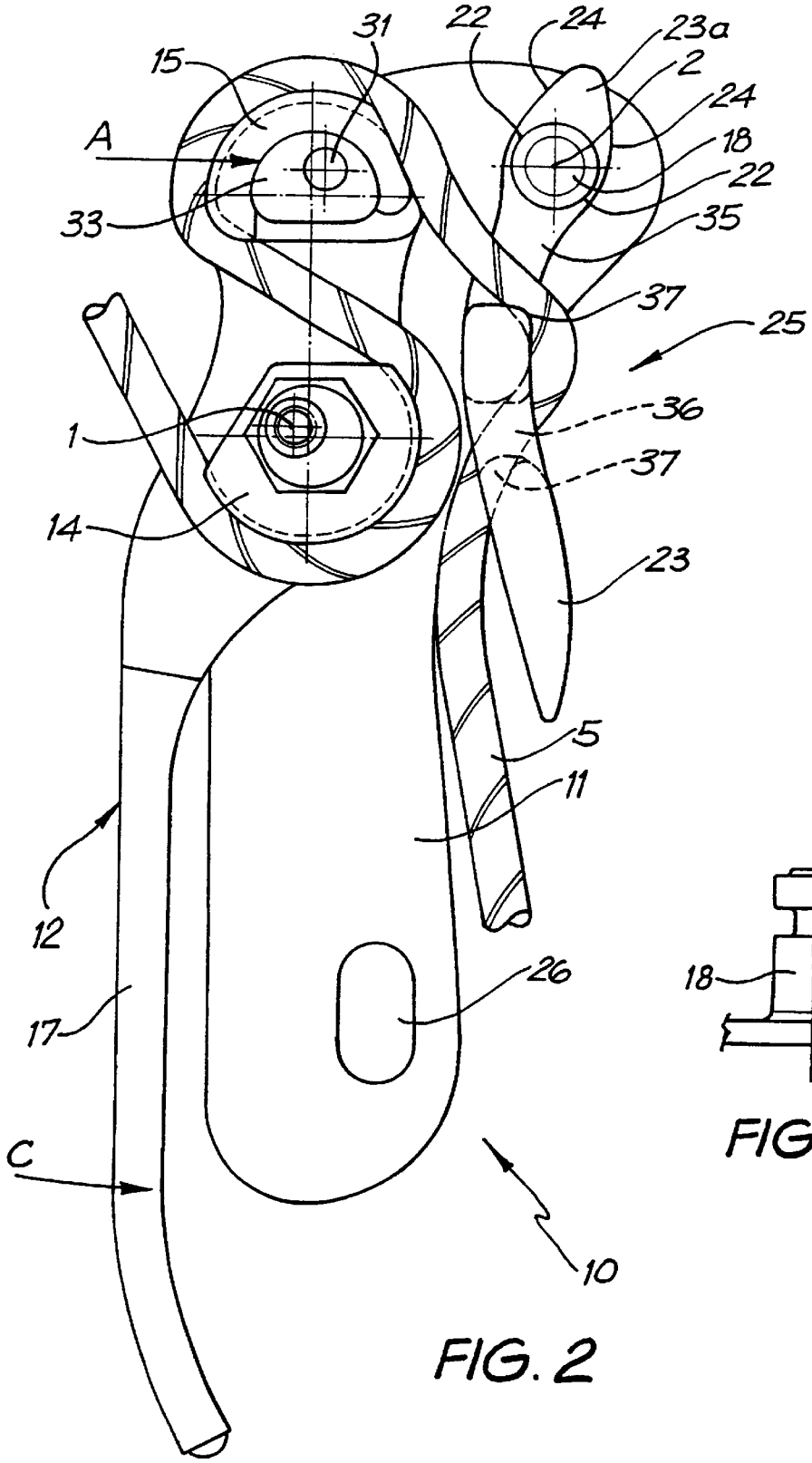
FIG. 2 shows the descender of FIG. 1 with the retention plate removed.
Figure 2A:
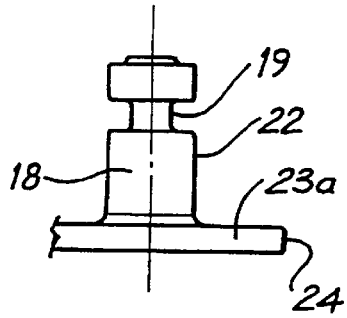
FIG. 2*a* is a side view of a stop means of the descender of FIG. 2.

Further, the lever 23 will be urged by the weight of the rope 5 and the friction of the rope 5 on the braking surface 22 into the position shown in FIG. 2. In this position of the handle 17 and lever 23, die rope 5 is pressed between the second sheave 15 and the braking surface 22 of the stop member 18 which will create an additional braking force on the rope 5 and which is preferably sufficient to stop the descent of the user. (FIG. 2 shows a gap between the rope on the second sheave and the stop member 18, in practice in the situation described above, the sheave 15 would move in direction A to compress the rope 5 against the stop member 18).

Since the rope 5 passes through the retention arrangement 25 on the lever 23, the user can simply move the tail of the rope 5 relative to the descender 10 so as to selectively pivot the lever 23.

When the tail of the rope 5 and the lever 23 are kept generally parallel to the longitudinal extent of the descender 10, the additional braking force is maximised. When the tail of the rope 5 is selectively moved laterally away from the descender 10, the lever 23 will move with the tail of the rope and pivot in the direction F (refer to FIG. 3) whereby the cam surface 24 defined by the tip portion 23*a* of the lever will contact the second sheave 15 maintaining a gap G between the sheave 15' and the braking surface 22 (refer to FIG. 3). This gap is typically wider than the rope 5, and thus releases the rope and effectively reduces the additional braking force.

Figure 3:
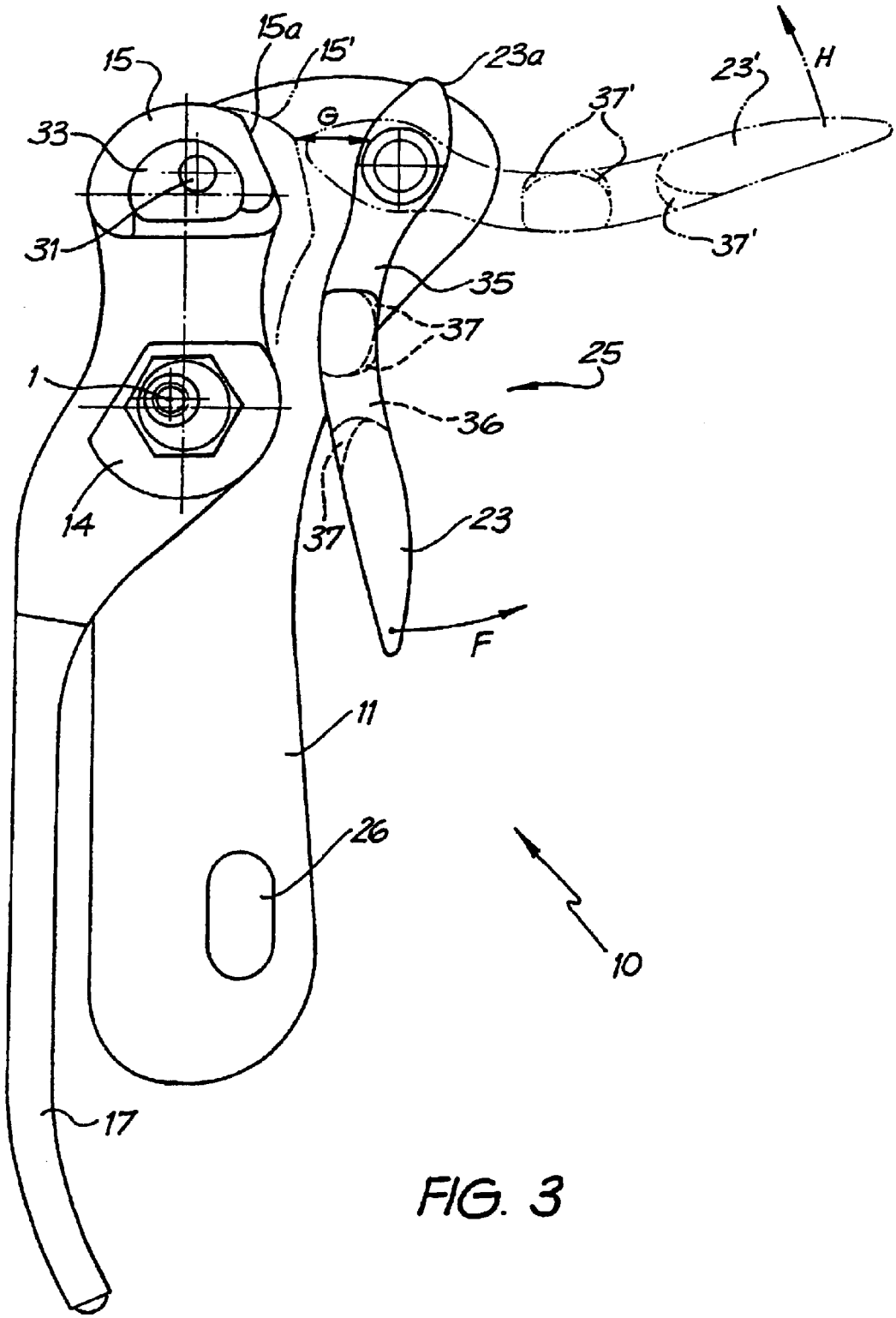
FIG. 3 shows a detailed view of the cam and lever of the variable braking mechanism.
Figure 4:
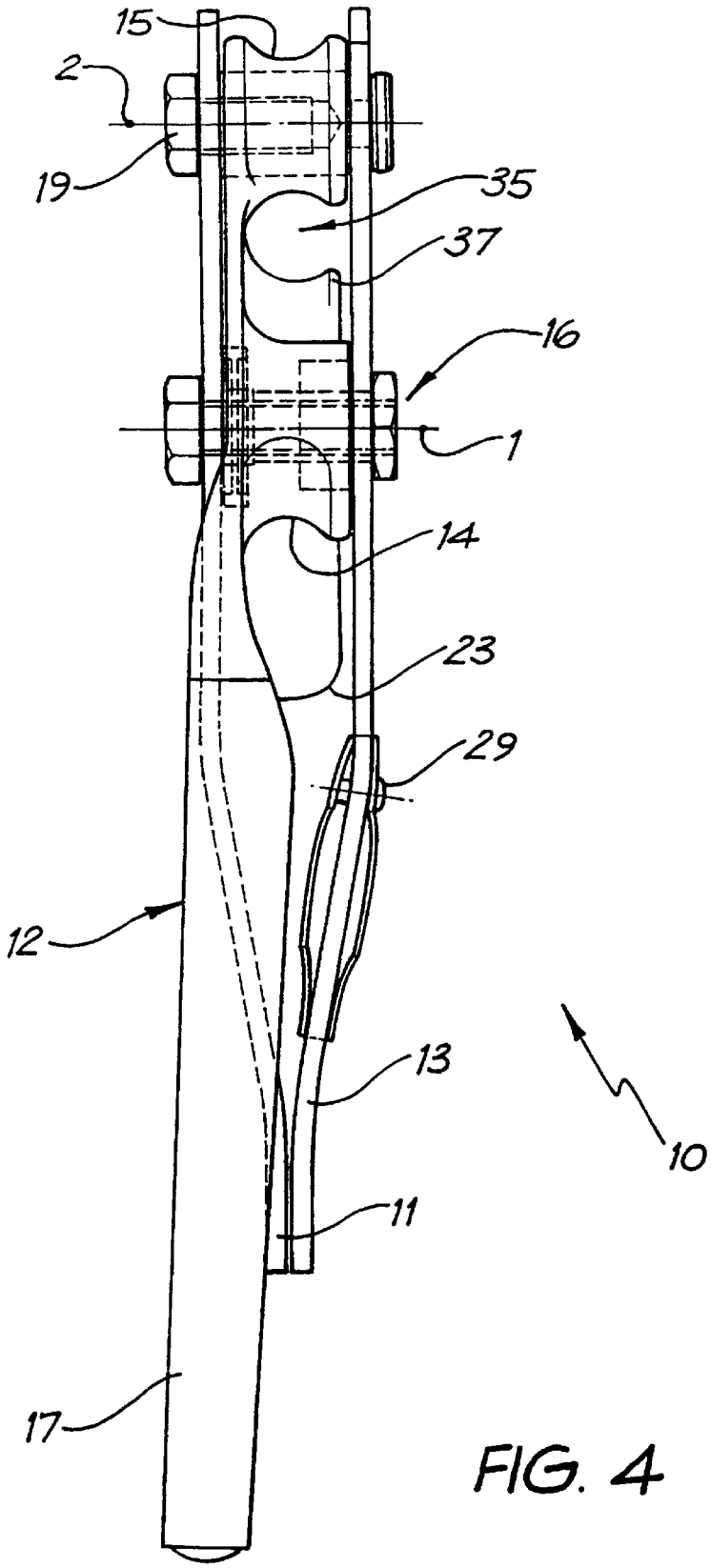
FIG. 4 shows a side elevational view of the descender of FIG. 1.

Importantly, movement of the lever beyond the position shown in phantom in FIG. 3 in the direction of H will cause the gap G between the sheave and braking surface to diminish thus increasing the braking force. Thus, either end of the lever's arcuate travel about axle 2 results in maximum braking force with the interim middle portion 23' providing reduced braking force. This makes the descender inherently safer than existing models as it will brake if pushed to either extreme.

It will be appreciated that the effective movement of the cam surface 24 relative to the second sheave 15 by simply manipulating the tail end of the rope 5 as described above will provide a smooth variation in the additional braking force. In this way the variable braking mechanism 21 allows an inexperienced user to smoothly control the application of the additional braking force and thereby avoid jerky stops and starts which can be experienced when operating the descender 10 with the handle 17. As such, the variable braking mechanism 21 provides an alternative means of disengaging the self-acting brake which is easier to control than by using the handle 17, and which does not detract from the ability of the brake to be self-acting in emergency situations. When the descender is used to lower loads, as might be the case in rescue situations, with heavier loads approaching 200 kg, the handle 17 does not provide sufficient travel and adjustment of braking to control the load in a satisfactory manner. However, the lever 23 can be used with a good degree of control with relatively heavier loads of 200 kg, as its arc of travel, is greater than that of the handle and its distance to its pivot point less.

Figure 5:
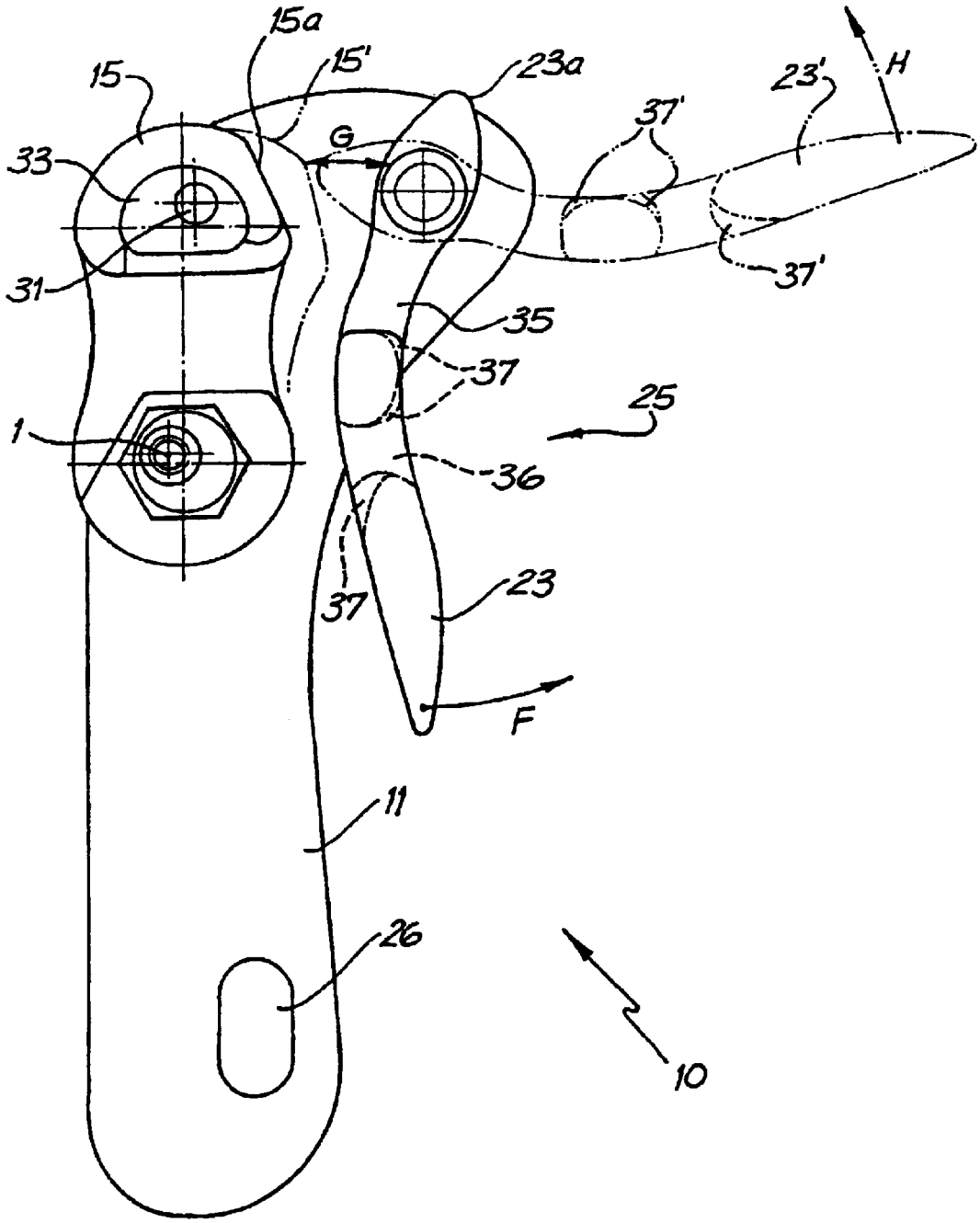
FIG. 5 shows a variant of the descender of FIG. 1.

FIG. 5 illustrates an alternative embodiment of the invention in which handle 17 for controlling the pivotable member is dispensed with and all the braking is controlled by lever 23. This embodiment has cost advantages over the first embodiment and again is inherently safe as the movement of the lever to either extreme maximises the braking forces.

FIGS. 6 to 9 show a yet further descender 100 embodying the present invention. In this embodiment parts which have the same function as those described above in relation to FIGS. 1 to 5 are given the same reference number with a single apostrophe. The descender 100 has a base plate 11', a pivotal member 12', and a top plate 13' (refer to FIG. 7). In contrast with the embodiments of FIGS. 1 to 5, the top plate is fixed relative to the base plate.

Figure 7:
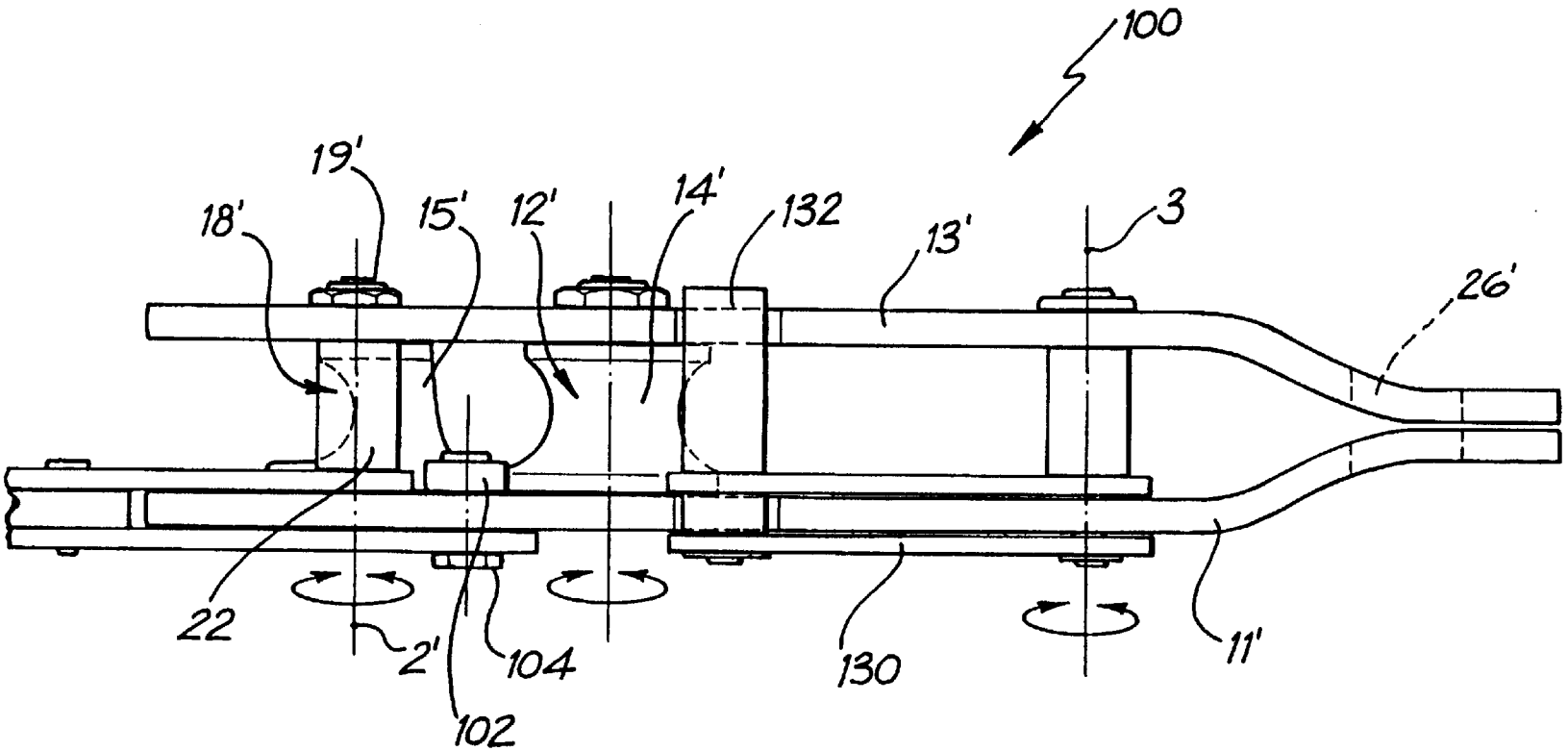
FIG. 7 shows a side elevational view of the descender of FIG. 6 with the top plate shown.

As in the first embodiment, the pivotal member 12' includes first and second spaced, sheaves 14' and 15' and is pivotally mounted to the baseplate 11' and top plate 13' by a pivot arrangement about pivot axis 1. In FIG. 7 parts of the pivotal member which are obscured by other components of the descender are shown in phantom. As in the first embodiment, the effective centre of the first sheave 14' is either co-axial with, or slightly offset from, the pivot axis 1'.

A cylindrical stop member 18' is mounted on a bolt 19' spaced from the pivotal member. The bolt defines a central axis 2'. The outer surface of the stop member 18' defines a cylindrical braking surface 22' against which, in use, a rope may bear as is described in more detail below. A lever 23' pivots about the axis 2' of the bolt 19', i.e. is coaxial with the cylindrical stop member 18'. Because the stop member 18' is co-axial with the bolt, pivoting the lever does not move the braking surface 22' relative to the second sheave 15'.

Figure 9:
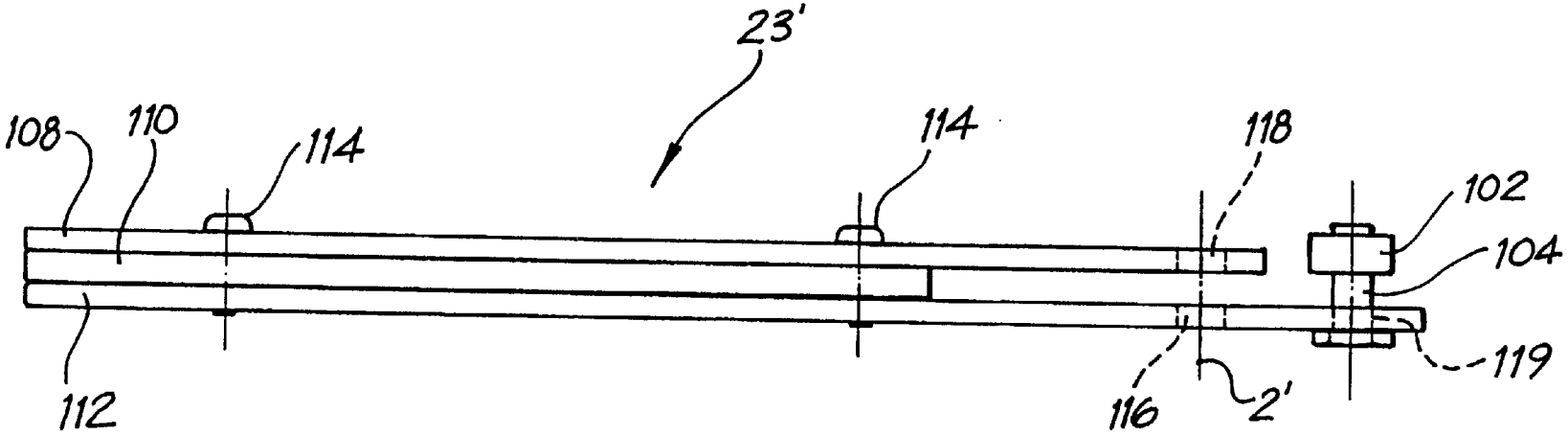
FIG. 9 shows a side view of a lever of the descender of FIGS. 6 to 8.

FIGS. 7 and 9 shows the lever 23' in more detail. At the end of the lever adjacent the braking surface 22', a cylindrical cam follower 102 having an annular cross-section is mounted on a bolt 104. The cam follower 102 is free to turn around the bolt. The outer surface of cam follower 102 defines a cam follower surface 102*a* (see FIG. 6). The bolt 104 projects through an arcuate slot 106 (refer to FIG. 6) in the base 11'. As the lever turns about the axis 2' of the bolt 19', the cam follower travels along an arcuate path along slot 106 from one end 122 of the slot to the other end 124. The lever may pivot about the axis 2' through roughly 90° each side from the position shown in FIG. 6. At each extreme end position, the lever is roughly parallel to the longest axis of the base plate.

With reference to FIG. 9, in the described embodiment, which is a prototype, the lever is made up of three plates 108, 110, 112 which are held together with screws 114. Both the lower and upper plates 108 and 112 define holes 116, 118 through with the bolt 19' passes by means of which the lever 23' is pivoted to the base 11'. The lower plate extends beyond the upper plate and its end defines a hole 16' for receiving the bolt 104 on which the cam follower is mounted. The middle plate 110 is co-planar with, and terminates near, the base 11'. It is envisaged that the lever will be made in one piece, in production.

Figure 6:
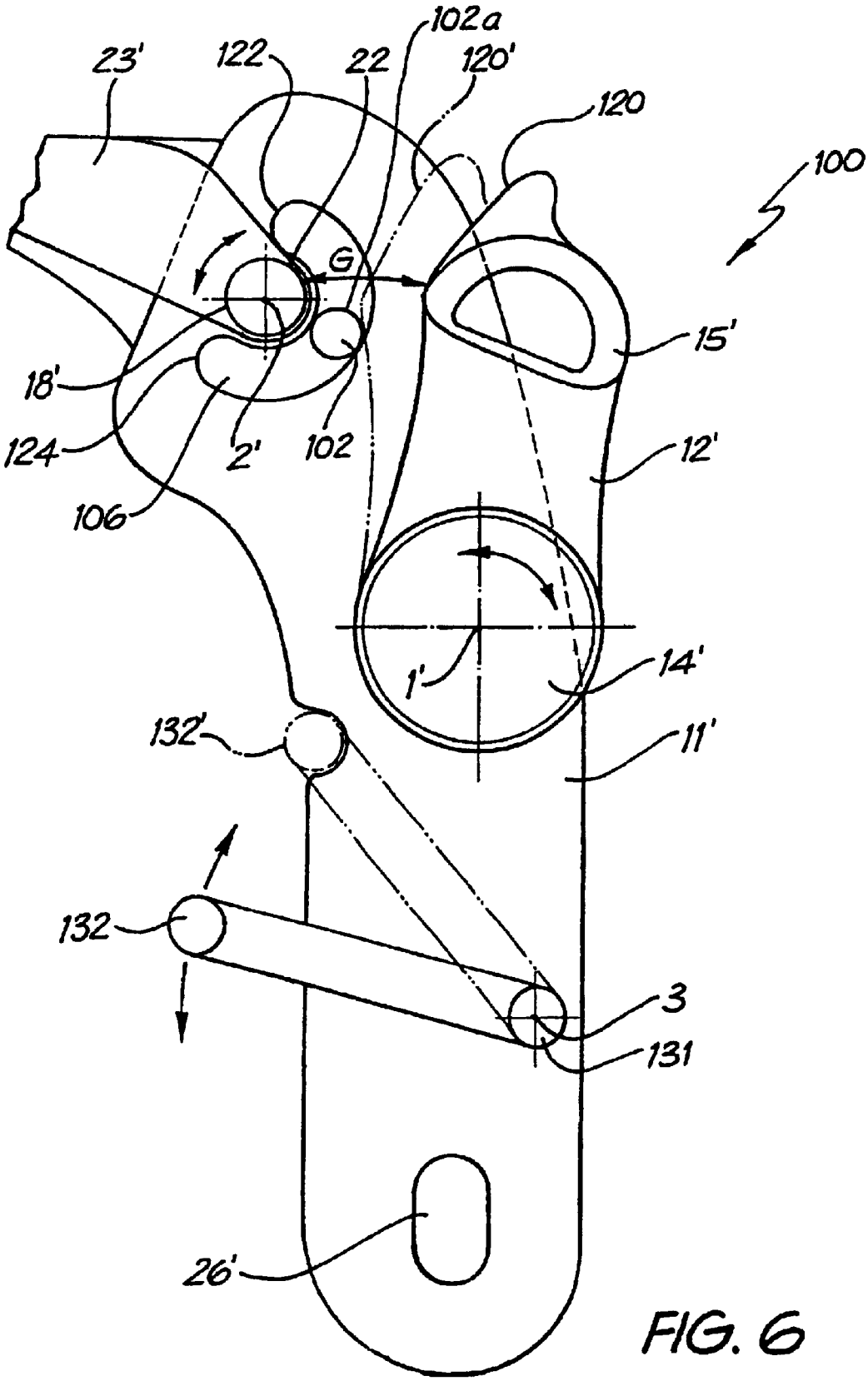
FIG. 6 shows a top plan view of a second embodiment of the present invention with a top plate removed.

Turning to FIG. 6, it can be seen that the pivotal member 12' defines a cam surface 120 facing the cam follower surface 102*a*.

Figure 8:
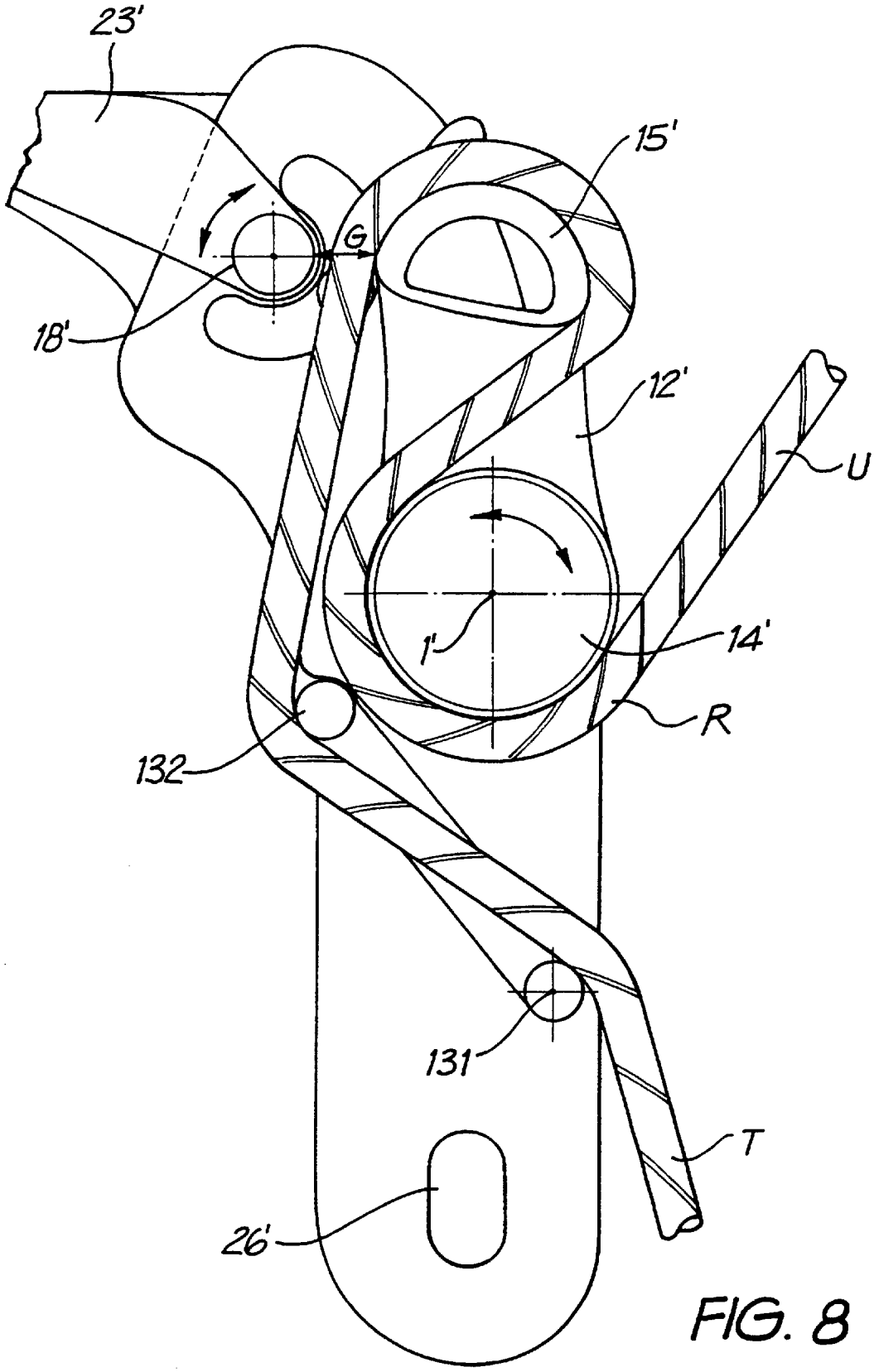
FIG. 8 shows a similar view to FIG. 6 with a rope threaded through the descender.

In the first embodiment of the present invention the descender included a retention plate which could be pivoted to allow rope to be inserted into the descender and securely retained therein. In the embodiment of FIGS. 6 to 9, insertion and retention of the rope is assisted by a lever 130. One end of the lever is pivoted to the base 11' about a post 131 defining a pivot axis 3. The other free end defines a post 132 mounted on that end of the lever. As seen in FIG. 8, in use, a rope R entering the descender passes by posts 131 and 132 and these help retain the rope in the descender and also increases the resistance to the rope passing through the descender. To engage a rope in the descender the rope is looped around the post 132, the lever pivots away from the base 11' to allow this (refer to FIG. 6) and the loop is then looped around sheave 15'.

The top and bottom plates define co-axial elongated holes 26' by which the descender 100 can be permanently connected to a harness during use, the connection, being generally by means of a karibiner.

When a rope is correctly threaded through the descender in use as is illustrated in FIG. 8, the pivotal member is biased to turn about pivot axis 1 in a direction which urges the second sheave towards the braking surface 22. When the lever is in or near a mid-position as shown in FIG. 6, the cam follower 102 maintains a relatively large gap 9 between the braking surface 22 and the sheave 15'. However as the lever moves towards either end extremity as the cam follower moves to either end 122 or 124 of the arcuate slot, the pivotal member pivots about axis 1 moving the sheave 15' towards the braking surface 22 and compressing the rope passing between the sheave 15' and the braking surface 22.

Again with this descender, in operation the braking on the rope is a maximum when the lever is moved to either end of its arc of travel. This is inherently safer than previous descenders, particularly in the case of novices who may use the descender and become panicked, as their reflex action typically would be to move the lever to either one of its two extreme positions which would result in maximum braking being applied to the rope.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A descender for use in abseiling comprising:

a base having a connection means for connection to a harness;

a pivotal member pivotally mounted on the base about a pivot axis extending generally normal thereto, the pivot axis being spaced from the connection means;

the pivotal member having first and second spaced projections for engaging a rope, the projections both extending generally parallel to the pivot axis with the first projection being disposed generally about the pivot axis and the second projection being located substantially on the opposite side of the pivot axis with respect to the connection means;

the base further having a generally cylindrical stop member defining a braking surface located adjacent the second projection and a lever defining a first end, and a second end, the lever being pivotal about a pivot extending through or located adjacent to the stop member, the first end of the lever defining a handle pivotable in an arcuate path between first and second end positions; and wherein the pivotal member and the other end of the lever define complementary displacing formations the formations being shaped and configured such that as the lever travels in its arcuate path about the pivot, they regulate the distance between the stop member and the second projection whereby, in use, a rope passing around and between the first and second projections and between the second projection and the braking surface will have a resistance force applied to it which is a minimum when the second projection is moved away from the stop member by actuating the lever to cause the complementary displacing formations to contact one another, thus decreasing the braking and friction forces on the rope as it passes between the second projection and the stop member and is at a maximum when the lever moves towards either end position of its arcuate path wherein the rope is pressed between the second projection mid the braking surface.

2. The descender as claimed in claim 1 wherein the complementary displacing formations comprise a cam surface defined on the other end of the lever and a cam follower surface defined by the pivotal member.

3. The descender as claimed in claim 2 wherein the cam surface is defined by a relatively tin plate above which the rope may pass.

4. The descender as claimed in claim 1 wherein the complementary displacing formations comprise a cam surface defined on the pivotal member and a cam follower defined on the other end of the lever.

5. The descender as claimed in claim 1 wherein the pivotal member also defines a handle member to selectively pivot the pivotal member relative to the base wherein, in use, a rope passing around and between the first and second projections and between the second projection and the braking surface will have a resistance force applied thereto which is at a minimum when the second projection is selectively moved away from the stop by actuating the handle member, and is at a maximum when the handle member is released and the tension of the rope causes the second projection to bear against the stop and press the rope between the braking surface and the second projection and thereby create an additional braking force.

6. The descender as claimed in claim 1 wherein the lever defines a retention means through which, in use, a tail of the rope passes after emerging from between the second projection and the braking surface so that the lever will move with the tail of the rope and may be actuated by changing the position of the tail of the rope relative to the descender.

7. The decender as claimed in claim 1 wherein the first and second projections define sheaves which are fixed relative to the pivotal member.

8. A descender for use in abseiling comprising:

a base having a connection means for connection to a harness;

a pivotal member pivotally mounted on the base about a pivot axis extending generally normal thereto, the pivot axis being spaced from the connection means;

the pivotal member having first and second spaced projections for engaging a rope, the projections both extending generally parallel to the pivot axis with the first projection being disposed generally about the pivot axis and the second projection being located substantially on the opposite side of the pivot axis with respect to the connection means;

the base further having a stop member defining a braking surface located adjacent the second projection and a lever having a first end and a second end, the lever being pivotal about a pivot extending through or located adjacent to the stop member, the first end of the lever defining a handle pivotable in an arcuate path between first and second end positions; and wherein the pivotal member and the second end of the lever define complementary displacing formations, a cam surface defined on the pivotal member and a cam follower surface defined on a cam follower at the second end of the lever, the cam surface comprising a relatively thin plate over which the rope may pass, the formations being shaped and configured such that as the lever travels in its arcuate path about the pivot, they regulate the distance between the stop member and the second projection whereby, in use, a rope passing around and between the first and second projections and between the second projection and the braking surface will have a resistance force applied to it which is a minimum when the second projection is moved away from the stop member by actuating the lever to cause the complementary displacing formations to contact one another, thus decreasing the braking and friction forces on the rope as it passes between the second projection and the stop member and is at a maximum when the lever moves towards either end position of its arcuate path wherein the rope is pressed between the second projection and the braking surface.

9. The descender as claimed in claim 8 wherein the cam follower is generally cylindrical.

10. The descender as claimed in claim 9 wherein the cam follower is co-axial with a bolt which projects through an arcuate slot, the arcuate slot defining extreme end positions of travel for the cam follower.

11. A descender for use in abseiling comprising:

a base having a connection means for connection to a harness;

a pivotal member pivotally mounted on the base about a pivot axis extending generally normal thereto, the pivot axis being spaced from the connection means;

the pivotal member having first and second spaced projections for engaging a rope, the projections both extending generally parallel to the pivot axis with the first projection being disposed generally about the pivot axis and the second projection being located substantially on the opposite side of the pivot axis with respect to the connection means;

the base further having a stop member located adjacent the second projection and a lever having a first end and a second end pivotal about a pivot extending through or located adjacent to the stop member, the stop member defining a braking surface the first end of the lever defining a handle pivotable in an arcuate path between first and second end positions; and wherein the pivotal member and the second end of the lever define complementary displacing formations, a cam surface defined on the second end of the lever and a cam follower surface defined by the pivotal member, the cam surface comprising a relatively thin plate over which the rope may pass, the formations being shaped and configured such that as the lever travels in its arcuate path about the pivot, they regulate the distance between the stop member and the second projection whereby, in use, a rope passing around and between the first and second projections and between the second projection and the braking surface will have a resistance force applied to it which is a minimum when the second projection is moved away from the stop member by actuating the lever to cause the complementary displacing formations to contact one another, thus decreasing the braking and friction forces on the rope as it passes between the second projection and the stop member and is at a maximum when the lever moves towards either end position of its arcuate path wherein the rope is pressed between the second projection and the braking surface, wherein the pivotal member defines a second handle to selectively pivot the pivotal member relative to the base wherein, in use, a rope passing around and between the first and second projections and between the second projection and the braking surface will have a resistance force applied thereto which is at a minimum when the second projection is selectively moved away from the stop by actuating the handle means, and is at a maximum when the handle means is released and the tension of the rope causes the second projection to bear against the stop and press the rope between the braking surface and the second projection and thereby create an additional braking force.

12. The descender of claim 11 wherein the lever defines a retention means at a position spaced from the cam surface and trough which, in use, a tail of the rope passes after emerging from between the second projection and the braking surface so that the lever will move with the tail of the rope and may be actuated by changing the position of the tail of the rope relative to the descender.

13. The descender of claim 12, wherein the retention means comprises a pair of recesses in the lever through which, in use, the tail of the rope is threaded.

* * * * *